US007347404B2

(12) United States Patent
Anzai

(10) Patent No.: US 7,347,404 B2
(45) Date of Patent: Mar. 25, 2008

(54) SHELF-RECEIVING METAL ELEMENT

(75) Inventor: Tadashi Anzai, Chiyoda-ku (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 295 days.

(21) Appl. No.: 10/538,233

(22) PCT Filed: Dec. 11, 2003

(86) PCT No.: PCT/JP03/15875

§ 371 (c)(1),
(2), (4) Date: Jun. 9, 2005

(87) PCT Pub. No.: WO2004/052151

PCT Pub. Date: Jun. 24, 2004

(65) Prior Publication Data

US 2006/0049323 A1 Mar. 9, 2006

(30) Foreign Application Priority Data

Dec. 12, 2002 (JP) ..... 2002-360334

(51) Int. Cl.
*A47B 96/06* (2006.01)

(52) U.S. Cl. ..... 248/250; 248/235; 108/152

(58) Field of Classification Search ..... 248/250, 248/235, 247, 248, 241; 108/152, 108
See application file for complete search history.

(56) References Cited

U.S. PATENT DOCUMENTS

| | | | | | |
|---|---|---|---|---|---|
| 4,691,887 | A | * | 9/1987 | Bessinger | 248/250 |
| 4,709,892 | A | * | 12/1987 | Gurgui | 248/250 |
| 4,736,918 | A | * | 4/1988 | Bessinger | 248/250 |
| 5,064,158 | A | * | 11/1991 | Brazier et al. | 248/250 |
| 5,456,435 | A | * | 10/1995 | Sweeney | 248/250 |
| 5,695,163 | A | * | 12/1997 | Tayar | 248/243 |
| 5,775,656 | A | * | 7/1998 | Roberts et al. | 248/250 |

FOREIGN PATENT DOCUMENTS

| | | | |
|---|---|---|---|
| JP | 58-7877 | Y2 | 2/1983 |
| JP | 7-15476 | Y2 | 4/1995 |
| JP | 3078692 | U | 4/2001 |
| JP | 2005040449 | A * | 2/2005 |

* cited by examiner

*Primary Examiner*—Anita M. King
(74) *Attorney, Agent, or Firm*—Pearne & Gordon LLP

(57) ABSTRACT

A wall body attachment unit (1) is secured by screws (2) to a wall body (W), a shelf board support unit (4) is removably attached to the wall body attachment unit (1) by engaging a curved engagement portion (4*a*) into a corresponding engaged portion of the wall body attachment unit (1). The shelf board support unit (4) holds a shelf board between a shelf board holding board portion (4*b*) and a shelf board holding lower board portion (4*e*) while a distance between the upper and lower members (4A) and (4B), which are secured to each other. Thus, the shelf board (3) can be supported by the shelf board support unit (4) at a low position on the ground, but not at an attachment position on the wall body.

14 Claims, 7 Drawing Sheets

PRIOR ART

SHELF-RECEIVING METAL ELEMENT

TECHNICAL FIELD

This invention relates to a shelf bracket adapted to be applied suitably for supporting a shelf board onto a wall surface of a residence or a wall surface of furniture and others.

BACKGROUND OF TECHNOLOGY

A shelf bracket according to one of the prior arts is disclosed in JU7-15476 (Japanese Utility Model Application Publication No. 15476/1995). This prior shelf bracket is an improvement on the conventional shelf bracket shown in FIG. 10.

The shelf bracket shown in FIG. 10 comprises a support board 41 to support a shelf board 3 thereon and a generally reverse L-shaped forcing board 42 extending from the base end of the support board 41 to receive the shelf board 3 together with the support board 41. The shelf bracket is attached to a wall body W by securing a generally triangular base 43 formed integrally with the support board 41 by wooden screws or the likes to the wall body and the shelf board 3 is secured to one or both of the forcing board 42 and the support board 41 by a not shown screw or screws.

However, since the prior shelf bracket attaches the shelf board 3 by inserting one side end of the shelf board 3 between the support board 41 and the forcing board 42 of the shelf bracket, which is previously secured to the wall body W at its high position, the operation has to be made at the high position, which causes the poor effectiveness of the operation and in addition, if the shelf board could not be engaged between the support board 41 and the forcing board 42 by the cause of the size error, then the one side end of the shelf board 3 should be adjusted in its thickness by shaving it. If the degree of shaving would be inaccurate, the shaving operation had to be repeated, which disadvantageously causes the substantial operation time and labor to be consumed.

If the shelf board would be too shaved, another new shelf board 3 should be used and there was required a remarkable size precision of the shelf bracket and the shelf board 3 produced separately from each other because the sizes of them should accord with each other. Accordingly, the manufacture of them was troublesome and also the accordance of the sizes should be fully care of when the shelf board and the shelf bracket should be bought.

The shelf bracket disclosed in the aforementioned patent document has been proposed in order to delete such disadvantages and is shown in FIG. 11.

This shelf bracket does not comprise a united single member, but comprises an upper member B1 and a lower member B2, which can relatively move upward and downward by slipperily engaging an elongated protrusion b21 of the lower member B2 with a longitudinal groove b11 of the upper member B1. Thus, as the upper member B1 upwardly moves relative to the lower member B2, a distance L between a shelf board holding upper board portion b12 of the upper member B1 and a shelf board holding lower board portion b22 of the lower member B2 can be so adjusted as to accord with the thickness of the shelf board 3. In this state, the upper member B1 and the lower member B2 are securely attached to the wall body W by threadedly thrusting into the wall body W screws 2 extending through respective holes b13 and b23 in the upper and lower members B1 and B2.

In this manner, the shelf bracket disclosed in the patent document can positively support the shelf board 3 by engaging the shelf board 3 between the upper and lower holding board portions b12 and b22 of the upper and lower members B1 and B2 while maintaining the distance L between the upper and lower holding board portions b12 and b22 obtained by adjusting the space between them in accordance with the shelf board to be attached onto the shelf bracket and threadedly thrusting screws 5 extending through screw extension holes b13 in the upper holding board portion b12.

In this prior shelf bracket, since the distance L between the upper and lower holding board portions b12 and b22 can be analogously adjusted in spite of variation in the thickness of the shelf board 3, the shelf bracket can be adjusted in accordance with the shelf board 3 in site either for the thicker shelf board 3 as shown in FIG. 11A or for the thinner shelf board 3 as shown in FIG. 11B and therefore it is advantageously not required to shave the shelf board 3.

However, the prior shelf bracket disclosed in this patent document has various problems as described hereinafter.

This prior shelf bracket is secured to the wall body W by threadedly thrusting the screw 2 into the wall body W when the distance L reaches a predetermined value by adjusting the distance L to the predetermined value by slipperily moving the upper member B1 in an upward direction or the lower member B2 in a downward direction while the upper and lower members B1 and B2 are maintained to be forced against the wall body W in the state where the upper and lower holding board portions b12 and b22 of the shelf bracket are slipperily engaged with each other.

However, since the aforementioned operation is made at a high place, it will take substantial time to threadedly thrust the screw 2 while maintaining the size precision of the distance L and also the operation itself gets troublesome. In addition thereto, in some cases, the distance L would require its readjustment and in case where the shelf board should be replaced by that having the different thickness, the former shelf board 3 is removed, the screw 2 is withdrawn and thereafter the replaced shelf board 3 has to be attached, but since all of these operations should be done at the high place, the effectiveness of the operations gets disadvantageously lower.

One of the objects of the invention is to provide a shelf bracket adapted to be able to adjust a distance between board upper and lower holding board portions of upper and lower members at a lower place in order to accord this distance with the thickness of the shelf board to be held between the upper and lower holding board portions.

Another object of the invention is to provide a shelf bracket adapted to positively hold a shelf board with high reliability without loosing the shelf board relative to the upper and lower holding board portions of upper and lower members.

Further object of the invention is to provide a shelf bracket adapted to securely attach a shelf board to upper and lower holding board portions of upper and lower members at the same time when the distance between the upper and lower holding board portions is adjusted in order to accord the distance with thickness of the shelf board to be held between the upper and lower holding board portions.

Further object of the invention is to provide a shelf bracket adapted to positively support a shelf board between upper and lower holding board portions of upper and lower members even though it has a small thickness.

DISCLOSURE OF THE INVENTION

According to a first form of embodiment of the invention, there is provided a shelf bracket characterized by comprising a wall body attachment unit having an engaged portion of depression or projection formed by being upwardly or downwardly curved or bended to be capable of being attached to a wall body W and a shelf board support unit having an engagement portion of projection or depression formed by being upwardly or downwardly curved or bended to be engaged with the engaged portion of the wall body attachment unit to be removably attached to one side end of a shelf board, the shelf board support unit comprising an upper member including a forcing upper board having a shelf board holding upper board portion provided integrally with the engagement portion and a shelf thickness adjustment vertical board suspending from the forcing upper board and a lower member including a shelf board holding lower board portion on which a shelf board is to be mounted and a shelf thickness adjustment vertical board extending vertically and upwardly from the shelf board holding lower board portion; and the shelf thickness adjustment vertical board of the lower member and the shelf thickness adjustment vertical board of the upper member being slipperily engaged with each other and secured to each other by screws whereby the one side end of the shelf board is held between the shelf board holding lower board portion of the lower member and the shelf board holding upper board portion of the upper member.

In the first fundamental form of the invention, the shelf thickness adjustment vertical board of the upper member has shelf thickness adjustment elongated holes, the shelf thickness adjustment vertical board of the lower member comprises a pair of board walls having an engagement groove provided with an upward opening into which the shelf thickness adjustment vertical board of the upper member is to be engaged and the pair of board walls of the shelf thickness adjustment vertical board may be in the form of having a screw head extending hole and a screw threading hole, respectively. The shelf thickness adjustment vertical boards of the upper and lower members may have slip prevention roughness provided on the forcing surfaces faced to each other, if necessary.

Otherwise, in the first fundamental form of embodiment of the invention, the shelf thickness adjustment vertical board of the lower member has a shelf thickness adjustment elongated hole, the shelf thickness adjustment vertical board of the upper member comprises a pair of board walls having an engagement groove provided with a downward opening into which the shelf thickness adjustment vertical board of the lower member is to be engaged, and the pair of board walls of the shelf thickness adjustment vertical board may be in the form of having screw head extending holes and screw threading holes, respectively. The shelf thickness adjustment vertical boards of the upper and lower members may have slip prevention roughness provided on the forcing surfaces faced to each other, if necessary.

In the first fundamental form of embodiment of the invention, the shelf thickness adjustment vertical board of the upper member has a shelf thickness adjustment elongated hole and the shelf thickness adjustment vertical board of the lower member may be in the form of having a screw threading hole. Reversely, the shelf thickness adjustment vertical board of the lower member has a shelf thickness adjustment elongated hole and the shelf thickness adjustment vertical board of the upper member may be in the form of having a screw threading hole. In these cases, the shelf thickness adjustment vertical boards of the upper and lower members may also have slip prevention roughness provided on the forcing surfaces faced to each other, if necessary.

According to a second form of embodiment of the invention, there is provided a shelf bracket characterized by comprising a wall body attachment unit having an engaged portion of depression or projection formed by being upwardly or downwardly curved or bended to be capable of being attached to a wall body W and a shelf board support unit having an engagement portion of projection or depression formed by being upwardly or downwardly curved or bended to be engaged with the engaged portion of the wall body attachment unit to be removably attached to one side end of a shelf board, the shelf board support unit comprising an upper member including a forcing upper board having an upper holding board portion provided integrally with the engagement portion and a shelf thickness adjustment vertical board suspending from the forcing upper board and a lower member including a lower holding board portion on which the shelf board is to be mounted and a shelf thickness adjustment vertical board extending vertically and upwardly from the lower holding board portion; and the shelf thickness adjustment vertical board of the lower member and the shelf thickness adjustment vertical board of the upper member being slipperily engaged with each other and secured to each other by screws whereby the one side end of the shelf board is held between the shelf board holding lower board portion of the lower member and the shelf board holding upper board portion of the upper member; the lower member including a support leg comprising a wall body support portion to engage with the wall body and an adjustment portion extending from the wall body support portion; the support leg being secured by an adjustment screw to the a leading end of an support arm downwardly extending from a leading end of the lower holding board portion of the lower member toward the wall body while being adjusted in position relative to each other.

In the second fundamental form of the invention, the support leg and the support arm may also have slip prevention roughness provided on the forcing surfaces faced to each other, if necessary.

According to a third form of the invention, there is provided a shelf bracket characterized by comprising a wall body attachment unit having an engaged portion of depression or projection formed by being upwardly or downwardly curved or bended to be capable of being attached to a wall body W and a shelf board support unit having an engagement portion of projection or depression formed by being upwardly or downwardly curved or bended to be engaged with the engaged portion of the wall body attachment unit to be removably attached to one side end of a shelf board, the shelf board support unit comprising an upper member including a forcing upper board having a shelf board holding upper board portion provided integrally with the engagement portion and a shelf thickness adjustment vertical board suspending from the forcing upper board and a lower member including a lower holding board portion on which the shelf board is to be mounted and a shelf thickness adjustment vertical board extending vertically and upwardly from the lower holding board portion; and screws extending through and attached by the shelf thickness adjustment vertical board of the lower member to be attached thereto and extending through shelf thickness adjustment vertical board of the upper member so as to be vertically movable relative to the shelf thickness adjustment vertical board of the upper member and being threadedly engaged into the one side end of the shelf board whereby the one side end of the shelf board is held between the shelf board holding lower board portion of the lower member and the shelf board holding upper board portion of the upper member.

The third fundamental form of embodiment of the invention may be in the form of such a construction as screws extend from head extending holes in the shelf adjustment vertical board of the lower member through thickness adjustment elongated holes in the shelf adjustment vertical board in the upper member to be threadedly engaged into the one side end of the shelf board and the lower member may have an engagement groove which is provided between the shelf thickness adjustment vertical board and the shelf board holding lower board portion and into which the shelf thickness adjustment vertical board of the upper member is engaged. In case where the shelf board of small thickness is to be attached, the shelf board can be held between the shelf board holding upper board portion of the upper member and the shelf board holding lower board portion of the lower member by engaging the lower end of the shelf thickness adjustment vertical board of the upper member into the engagement groove.

According to the first fundamental form of embodiment of the invention, since the engagement portion of the shelf board support unit having the shelf board supported thereby can be speedily and easily attached to or removed from the wall body side attachment unit on the wall body by operating the shelf board supported by the shelf board support unit while grasping the shelf board, operation of supporting the shelf board on the shelf board support unit can be done at a low position on the ground and therefore the troublesome operation of supporting the shelf board including the thickness adjustment in accordance with the thickness of the shelf board can be done at a safety position.

Since the shelf board support unit on the side of the shelf board comprises the upper and lower members and the shelf thickness adjustment vertical board of the upper member is secured by the screws to the shelf thickness adjustment vertical board of the lower member so as to upwardly or downwardly move relative to the latter, the shelf board can be held between the shelf board holding lower board portion of the lower member and the shelf board holing upper board portion of the upper member so as to accord with the thickness of the shelf board and removed from them rapidly and easily by a simple operation.

The shelf thickness adjustment vertical board of the upper member and the shelf thickness adjustment vertical board of the lower member can accord with the thickness of the shelf by being engaged to each other in a faced manner and adjusting their vertical position to each other. Especially, as the thickness adjustment elongated hole is provided in the shelf thickness adjustment vertical board of the upper member, which is engaged into the engagement groove formed in the shelf thickness adjustment vertical board of the lower member and the shelf thickness adjustment vertical boards are tightened by the screws within the engagement groove in the shelf thickness adjustment vertical board of the lower member or reversely, as the thickness adjustment elongated hole is provided in the shelf thickness adjustment vertical board of the lower member, which is engaged into the engagement groove formed in the shelf thickness adjustment vertical board of the upper member and the shelf thickness adjustment vertical boards are tightened by the screws within the engagement groove in the shelf thickness adjustment vertical board of the upper member, the vertical position of the upper and lower members can be easily adjusted to be able to advantageously accomplish the easier operation of holding the shelf boards of various thicknesses.

In this case, with the slip prevention roughness provided on the faces of the upper and lower shelf thickness adjustment vertical boards forced against each other, the closeness of the vertical boards can be improved and therefore an unintentional looseness of the condition of holding the shelf board can be positively prevented.

Furthermore, as the support leg is secured by the screws to the leading end of the support arm of the lower member in an extensible or contractible manner and the wall body support portion of the support leg is engaged with the wall body, the load on the leading end of the lower member can be positively supported on the wall body.

As the shelf board is held between the upper and lower members by threadedly engaging into the one side edge face of the shelf board the screws loosely extending through the shelf thickness adjustment vertical boards of the upper and lower members so as to upwardly or downwardly moving the shelf thickness adjustment vertical board of the upper member relative to the shelf thickness adjustment vertical board of the lower member, but not by securing the upper and lower members by screws in the state where they are accorded with the shelf thickness, the state where the shelf board is held can be maintained even though much load might be applied to the shelf board by an association of the function of holding the shelf board with the function of securing the shelf board to the lower member by screws.

With the shelf thickness adjustment vertical board of the upper board engaged into the engagement groove formed between the shelf thickness adjustment vertical board and the shelf board holding lower board portion of the lower member, even the thinner shelf board can be positively held.

BRIEF DESCRIPTION OF THE DRAWINGS

FIG. 1 illustrates the state where a shelf bracket according to one form of embodiment of the invention is used, wherein FIG. 1A is a vertical cross-sectional view illustrating the use of a thicker shelf board, FIG. 1B is a vertical cross-sectional view illustrating the use of a thinner shelf board, and FIG. 1C is an enlarged vertical cross-sectional view of an engagement portion of shelf thickness adjustment vertical boards of upper and lower members of shelf board support unit of the shelf bracket of FIGS. 1A and 1B;

FIG. 9 illustrates a shelf bracket according to a further embodiment of the invention, wherein FIG. 9A is a vertical cross-sectional view illustrating the case of a thicker shelf board, and FIG. 9B is a vertical cross-sectional view of illustrating the use of a thinner shelf board;

FIG. 11 illustrates another shelf bracket according to the prior art, wherein FIG. 11A is a vertical cross-sectional view illustrating the use of a thicker shelf board, and FIG. 11B is a vertical cross-sectional view illustrating the use of a thinner shelf board.

BEST MODE OF EMBODIMENT OF INVENTION

Figure 1:
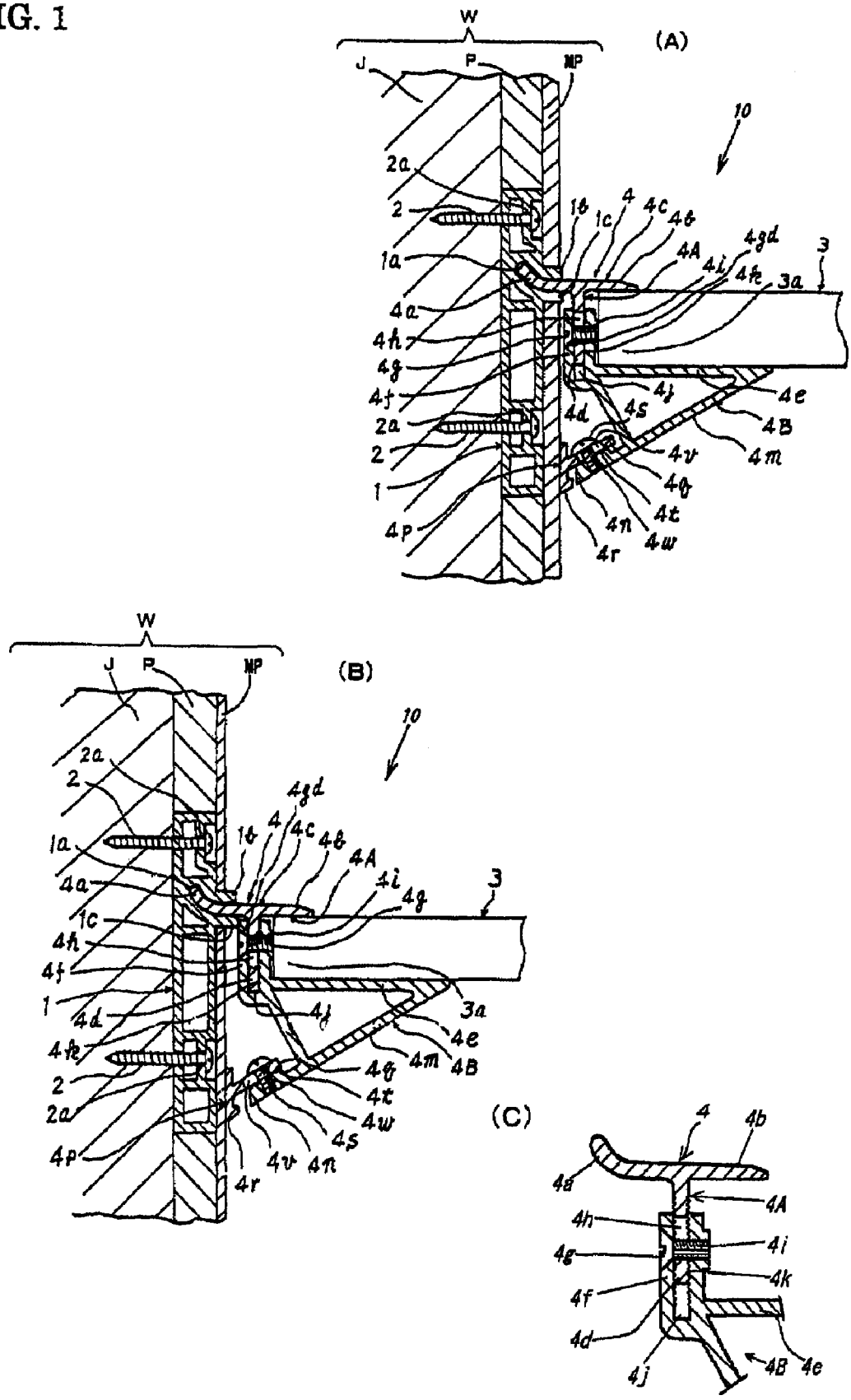

A shelf bracket according to one form of embodiment of the invention will be explained in details together with the state of being used with reference to FIGS. 1 and 2.

The shelf bracket 10 comprises a wall body attachment unit 1 to be attached to a wall body W and a shelf board support unit 4 to support a shelf board and to be removably attached to the wall body attachment unit 1. The wall body attachment unit 1, the shelf board support unit 4 and the shelf board 3 may be formed of metal, plastics or any other appropriate material.

The wall body attachment unit 1 may be formed longer in a transverse direction in an elongated manner and in the illustrated form of embodiment, may have threaded holes 2*a* through which tightening screws 2 are to extend and also a plurality of cavities for lightening the unit 1. The wall body attachment unit 1 may have also an engaged portion 1*a* into which an engagement portion 4*a* of an upper member 4A of the shelf board support unit 4, which will be described later. In the illustrated form, the engaged portion 1*a* may have the form of curved groove which is curved upwardly toward the depth of the wall body attachment unit 4.

Of course, the engaged portion 1*a* is not limited to the aforementioned form and it may be curved downwardly or bended upwardly and downwardly, but not curved. In any case, there may be formed the engaged portion 1*a* into which the engagement portion 4*a* of the second shelf board support unit 4 can be engaged so as not to be removed from the engaged portion.

The shelf board support unit 4 comprises an upper member 4A including a forcing upper board 4*c* having a shelf board holding upper board portion 4*b* provided integrally with the engagement portion 4*a* to be engaged into the engaged portion 1*a* of the wall body attachment unit 1 and a shelf thickness adjustment vertical board 4*d* suspending from the forcing upper board 4*c* and a lower member 4B including a shelf board holding lower board portion 4*e* on which a shelf board 3 is to be mounted and a shelf thickness adjustment vertical board 4*f* extending upwardly from the shelf board holding lower board portion 4*e*.

The shelf board support unit 4 is adapted to hold one side end 3*a* of the shelf board 3 between the shelf board holding lower board portion 4*e* of the lower member 4B and the shelf board holding upper board portion 4*b* of the upper member 4A so as to accord with the thickness of the shelf board 3 by securing the upper and lower members 4A and 4B by screws 4*g* at the predetermined relative position thereof while the shelf board holding upper board portion 4*b* of the upper member 4A engages the shelf board holding lower board portion 4*f* of the lower member 4B so as to be able to be vertically adjusted in position.

Thus, as shown in FIGS. 1A and 1B, the shelf bracket 10 of the invention can hold the shelf board 3 between the shelf board holding upper board portion 4*b* and the shelf board holding lower board portion 4*e* by adjusting the space between them in accordance with the thickness of the shelf board 3.

Figure 2:
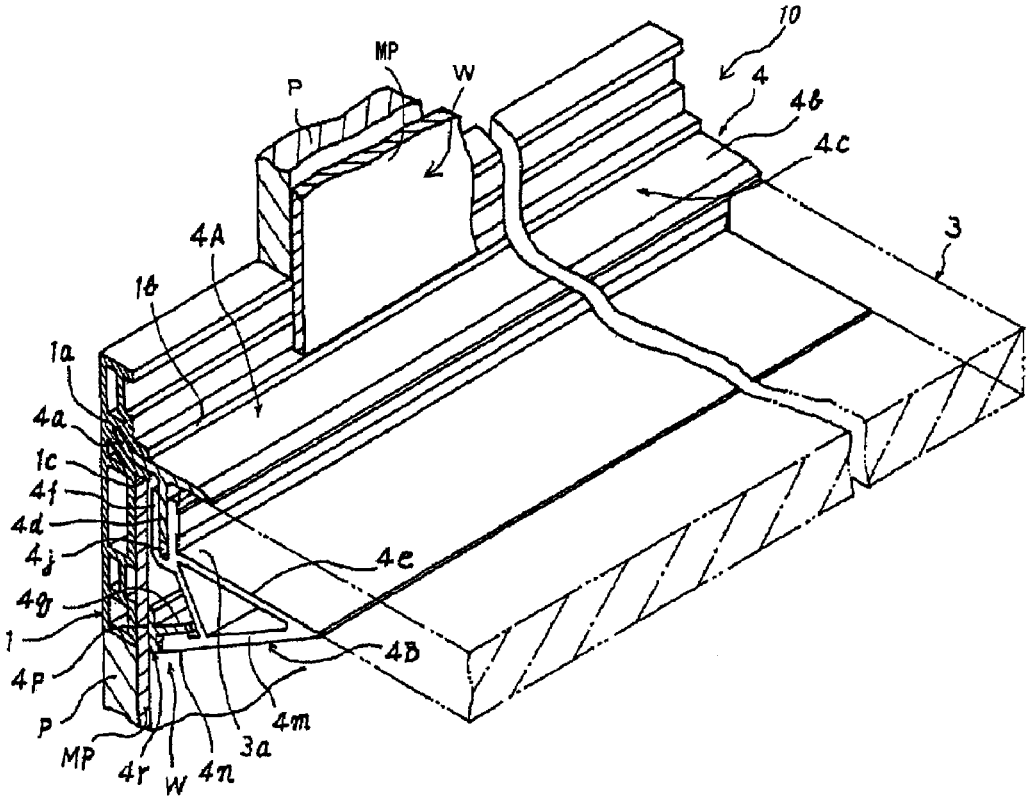
FIG. 2 is a perspective view of a main portion of the shelf bracket of FIG. 1.

In the form of FIGS. 1 and 2, the shelf thickness adjustment vertical board 4*d* of the upper member 4A may have thickness adjustment elongated holes 4*h* and the shelf thickness adjustment vertical board 4*f* of the lower member 4B may comprise a pair of board walls having an upwardly opened engagement groove 4*j* formed between them and into which the shelf thickness adjustment vertical board 4*d* is engaged. The pair of wall boards of the shelf thickness adjustment vertical board 4*f* may have head engaging holes 4*gd* through which the screws 4*g* extend and screw threading holes 4*i*, respectively. In the illustrated form, the pair of the shelf thickness adjustment vertical board 4*f* may be in the form of U-shape with the bottom portion continuously formed.

As shown in details in FIG. 1C, the shelf thickness adjustment vertical board 4*d* of the upper member 4A and the shelf thickness adjustment vertical board 4*f* of the lower member 4B may have slip prevention roughness 4*k* provided on the forcing surfaces faced to each other. The slip prevention roughness 4*k* serves to prevent the state of holding the shelf board 3 from being loosened due to its unintentional slip.

Figure 7:
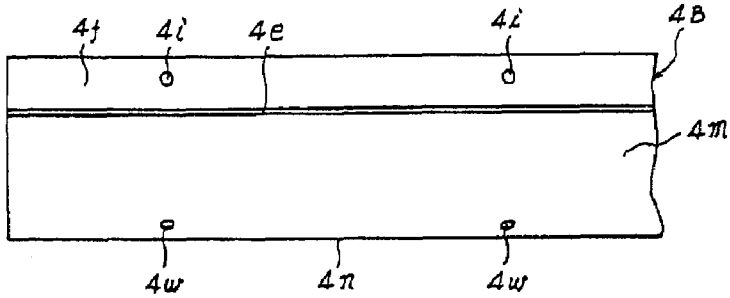
FIG. 7 is a front view of a portion of the lower member of the shelf board support unit of FIG. 1.
Figure 8:
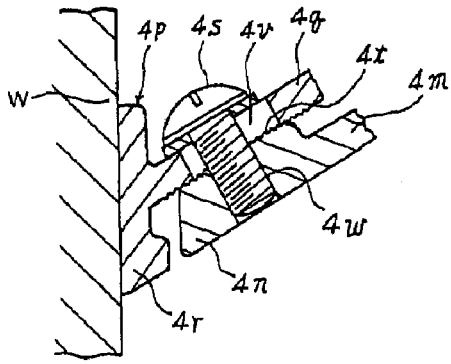
FIG. 8 is an enlarged vertical cross-sectional view of an adjustable support leg provided on the leading end of the support art of the lower member of the shelf board support unit.

In this manner, as the one side end 3*a* of the shelf board 3 is held between the shelf board holding upper board portion 4*b* of the upper member 4A and the shelf board holding lower board portion 4*e* of the lower member 4B with the space between them adjusted, the shelf board 3 can be easily and rapidly supported and the shelf board 3 can be supported by the shelf board support unit 4 with high strength by tightening the screws 4*g* after confirming the state where the shelf board is held. As noted from FIG. 7, the screws 4*g* are provided for each of screw head extension holes 4*gd* and screw threading holes 4*i* (holes 4*gd* not shown in FIG. 7) and therefore the shelf board 3 can be positively secured to the shelf board support unit 4.

Figure 4:
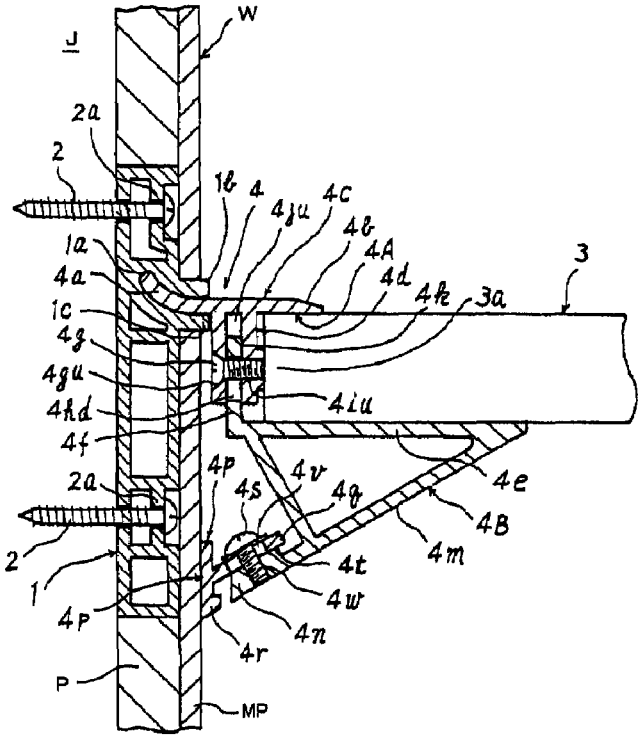
FIG. 4 is a vertical cross-sectional view of the shelf bracket according to a modification of the form of FIG. 1.

A modification of the shelf bracket 10 according to the form of FIGS. 1 and 2 is shown in FIG. 4. In this modification, the shelf thickness adjustment vertical board 4*f* of the lower member 4B may comprise a single board wall, which is different from the form of FIG. 1 and may have thickness adjustment elongated holes 4*hd* while the shelf thickness adjustment vertical board 4*d* of the upper member 4A comprises a pair of board walls having an engagement groove 4*ju* provided with an upward opening into which the shelf thickness adjustment vertical board 4*f* of the lower member 4B is to be engaged. Thus, it will be noted that in modification of FIG. 4, the state of engagement of the upper and lower shelf thickness adjustment vertical boards 4*d* and 4*f* is reverse to that of the form of FIGS. 1 and 2. In this case, the shelf thickness adjustment vertical board 4*d* of the upper member 4A and the shelf thickness adjustment vertical board 4*f* of the lower member 4B may have slip prevention roughness 4*k* provided on the forcing surfaces faced to each other as well.

Figure 5:
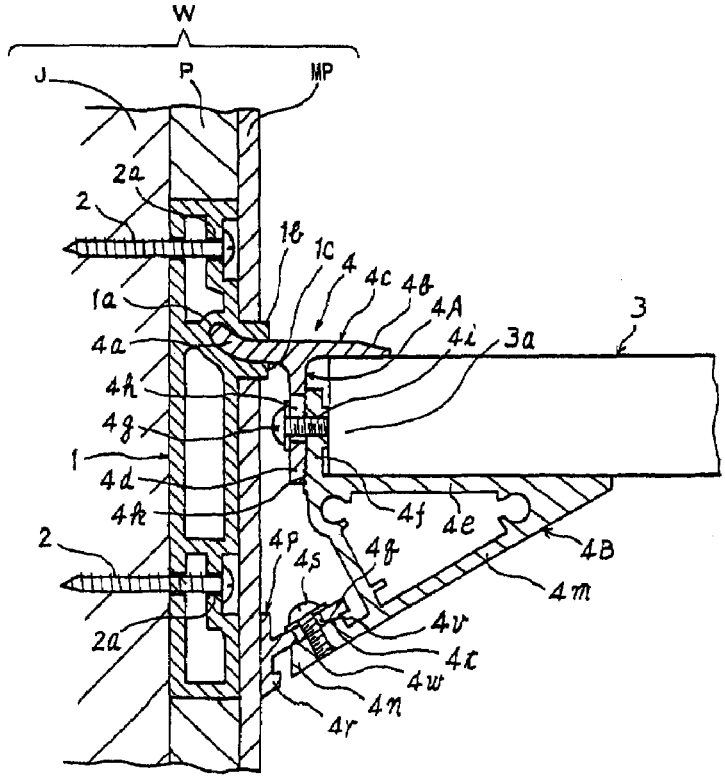
FIG. 5 is a vertical cross-sectional view of the shelf bracket according to another form of the invention.

A further modification of the shelf bracket 10 according to the forms of FIGS. 1 through 4 is shown in FIG. 5. In this modification, the shelf thickness adjustment vertical board 4*d* of the upper member 4A as well as the shelf thickness adjustment vertical board 4*f* of the lower member 4B may comprise a single board wall, the shelf thickness adjustment vertical board 4*d* of the upper member 4A may have thickness adjustment elongated holes 4*h* while the shelf thickness adjustment vertical board 4*f* of the lower member 4B may have screw threading holes 4*i* into which the screws 4*g* are threadedly engaged. In the illustrated embodiment, the shelf thickness adjustment vertical board 4*f* of the lower member 4B is positioned on the side of shelf board 3.

In this modification, the shelf thickness adjustment vertical boards 4*d* and 4*f* of the upper and lower members 4A and 4B may desirably have slip prevention roughness 4*k* provided on the forcing surfaces faced to each other as well.

Figure 6:
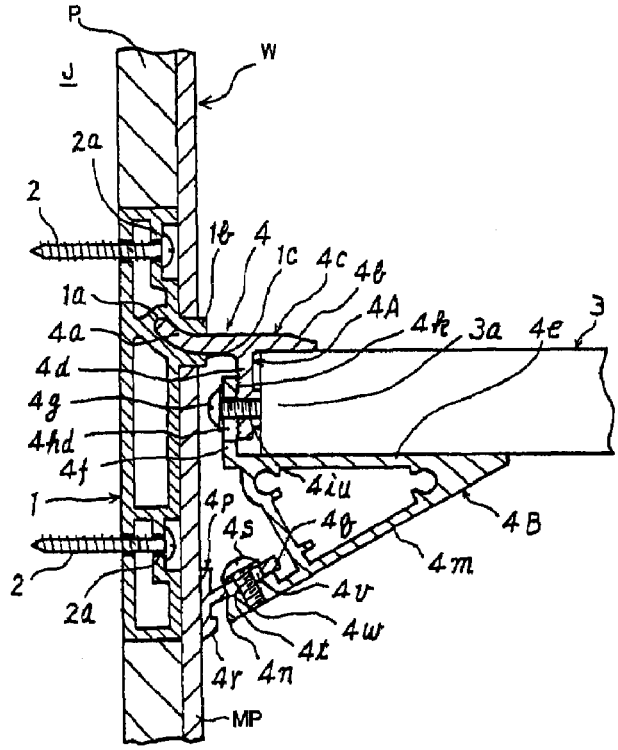
FIG. 6 is a vertical cross-sectional view of the shelf bracket according to the modification of the form of FIG. 5.

FIG. 6 shows the embodiment substantially identical to the modification of FIG. 5, but the position of the upper and lower members 4A and 4B relative to the shelf board 3 is reverse to that of FIG. 5. Therefore, it is different from that of FIG. 5 that the shelf thickness adjustment vertical board 4*f* of the lower member 4B may have thickness adjustment elongated holes 4*hd* provided therein while the shelf thickness adjustment vertical board 4*d* of the upper member 4A may have screw threading holes 4*iu* provided therein and into which the screws 4*g* are threadedly engaged.

The shelf bracket 10 in the form of FIGS. 1 through 6 comprises a support leg 4*r* to support the lower member 4B onto the wall body W in an adjustable manner. The support leg 4*r* may comprise a wall body support portion 4*p* to engage with the wall body W and an extensible and contractible adjustment portion 4*q* extending from the wall body support portion 4*p*. The extensible and contractible adjustment portion 4*q* has an elongated hole 4*v* and an adjustment screw 4*s* extends through the elongated hole 4*v* and is threadedly engaged into a leading end of a support arm 4*m* extending downwardly from the leading end of the lower board portion 4*e* of the lower member 4B toward the wall body W. The extensible and contractible adjustment portion 4*q* can set the length of the support arm 4*m* including the support leg 4*r* by adjusting the position of the elongated hole 4*v* where the screw 4*s* is tightened.

This support leg 4*r* can support the support arm 4*m* by extending the adjustment portion 4*q* from the support arm 4*m* while the screw 4*s* is loosened until the wall body support portion 4*p* engages the surface of the wall body W and then tightening the screw 4*s* when the shelf board support unit 4 is to be attached to the wall body attachment unit 1.

In this manner, the lower member 4B can be positively supported to the wall body W and the shelf board 3 can bear high load applied to the shelf board 3. In FIGS. 1, 4 through 8, a reference numeral 4*w* designates threaded holes provided in the leading end 4*n* of the support arm 4*m* and into which the adjustment screws 4*s* are threadedly engaged.

In the same manner as the upper and lower shelf thickness adjustment vertical boards 4*d* and 4*f* have slip prevention roughness 4*k* provided on the forcing surfaces faced to each other to prevent the looseness of both, the support leg 4*r* and the support arm 4*m* may desirably have slip prevention roughness 4*t*.

In case where the load applied to the shelf board 3 is not required to be supported by the support leg 4*r*, the lower member 4B may be separately spaced from the wall body W. Otherwise, as shown in another form of embodiment of the invention described later with reference to FIG. 9, the lower member 4B may be supported directly to the wall body W (see FIG. 9A) without using the adjustable support leg 4*r* or may be supported through cushion material 4*u* to the wall body W (see FIG. 9B).

Figure 9:
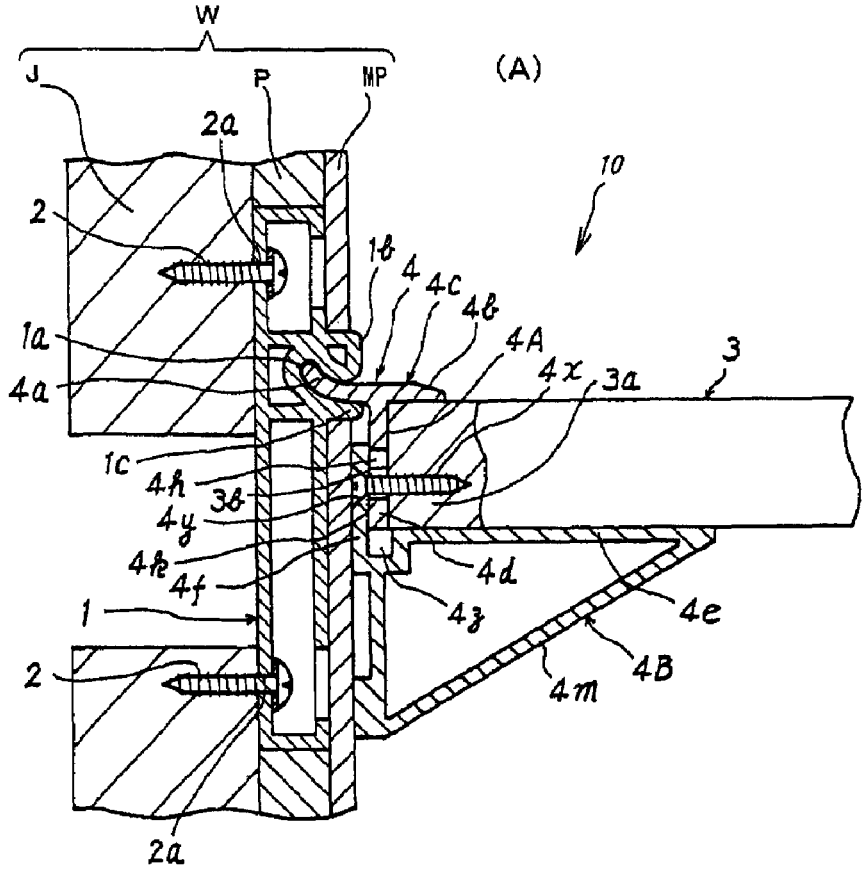
Figure 9:
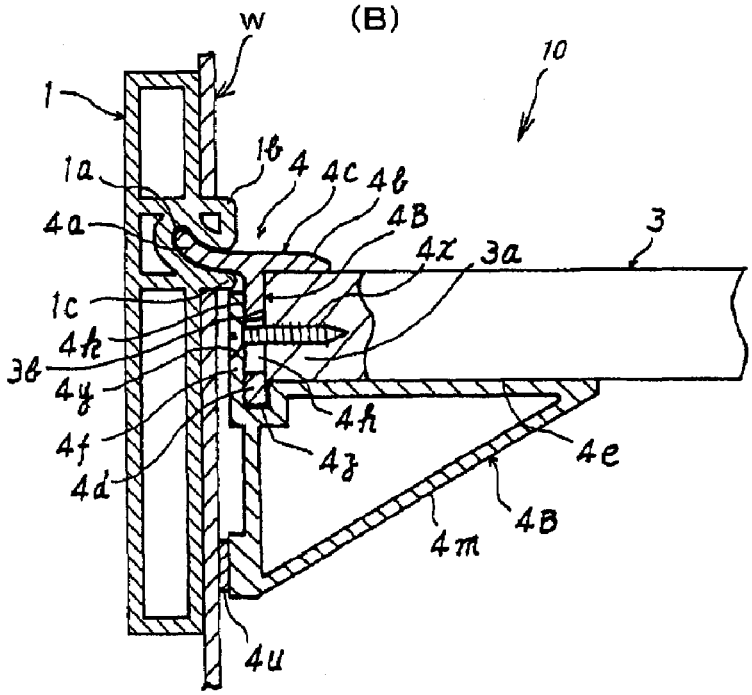
Figure 10:
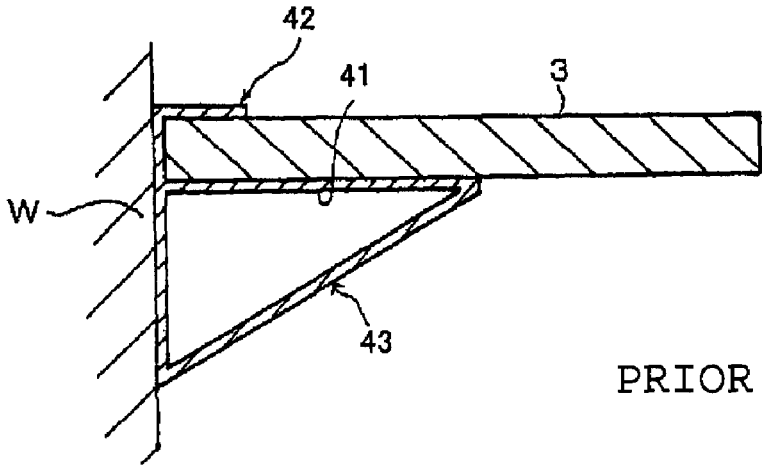
FIG. 10 is a vertical cross-sectional view of a shelf bracket according to the prior art.
Figure 11:
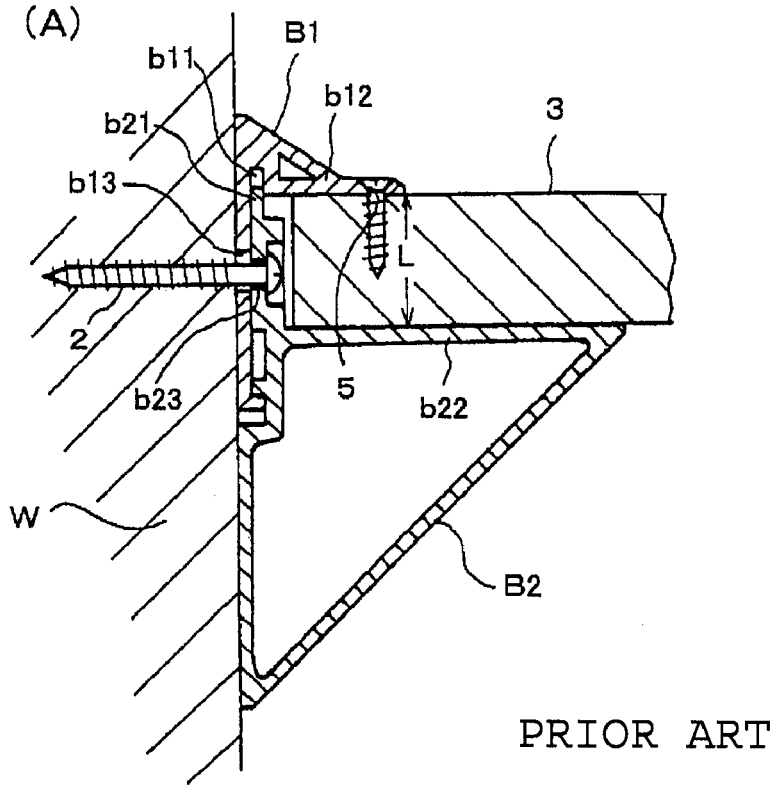
Figure 11:
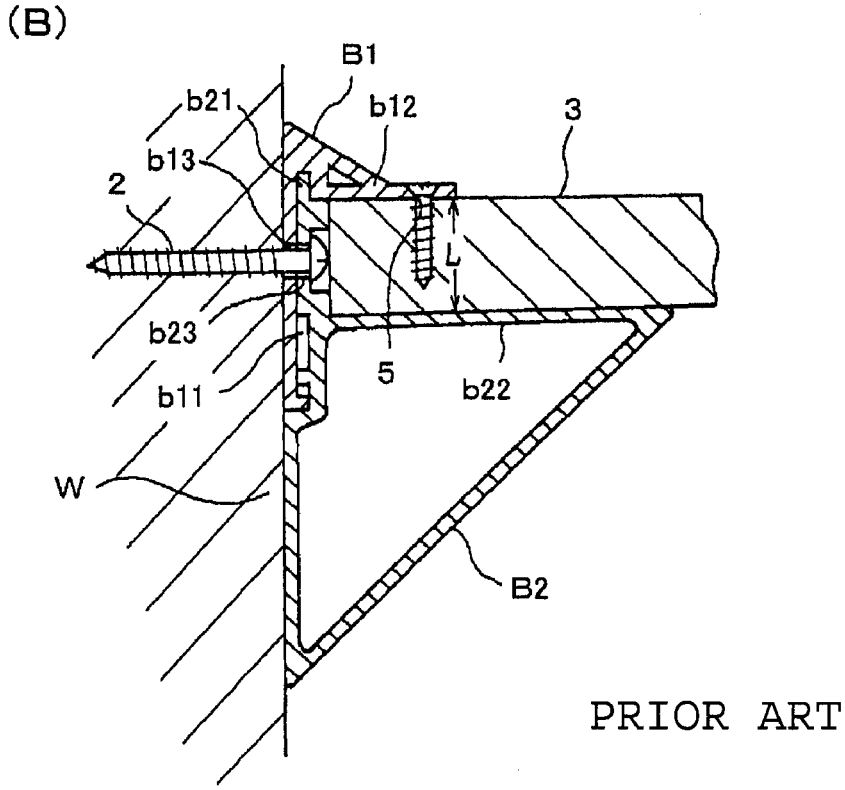

A shelf bracket 10 according to another form of embodiment of the invention is shown in FIG. 9 and has the same reference numerals attached to the same components.

The shelf bracket 10 according to this form of embodiment comprises the wall body attachment unit 1 having the engaged portion 1*a* of depression or projection formed by being upwardly or downwardly curved or bended to be capable of being attached to the wall body W and the shelf board support unit 4 having the engagement portion 4*a* of projection or depression formed by being upwardly or downwardly curved or bended to be engaged with the engaged portion 1*a* of the wall body attachment unit 1 to be removably attached to the one side end 3*a* of the shelf board 3, which is identical to that of the foregoing form of embodiment. This shelf board support unit 4 comprises the upper member 4A including the forcing upper board 4*c* having the shelf board holding upper board portion 4*b* provided integrally with the engagement portion 4*a* and the shelf thickness adjustment vertical board 4*d* suspending from the forcing upper board 4*c* and the lower member 4B including the shelf board holding lower board 4*e* on which the shelf board 3 is to be mounted.

The shelf bracket 10 according to the form of embodiment of FIG. 9 is provided with screws such as wooden screws 4*x*, for example, extending through the shelf thickness adjustment vertical board 4*f* of the lower member 4B and the shelf thickness adjustment vertical board 4*d* of the upper member 4A. In the illustrated form, these wooden screws 4*x* having heads engaged into respective head extending holes 4*y* and extending through respective thickness adjustment holes 4*h* in the shelf thickness adjustment vertical board 4*d* of the upper member 4A to thereby change the facing position of upper and lower vertical boards 4*f* and 4*d* so that the relative vertical position of the upper and lower members 4A and 4B can be adjusted. In this manner, the one side end 3*a* of the shelf board 3 can be held between the shelf board holding lower board portion 4*e* of the lower member 4B and the shelf board holding upper board portion 4*b* of the upper member 4A and at the same time the shelf board 3 can be secured to the upper and lower members 4A and 4B by threadedly engaaging the wooden screws 4*x* into the one side edge face 3*b* of the shelf board 3 in the state where the relative vertical position of the upper and lower members 4A and 4B is set in accordance with the thickness of the shelf board 3.

Also, in the form of embodiment of FIG. 9, there may be provided between thee shelf thickness adjustment vertical board 4*f* of the lower member 4B and the shelf board holding lower board portion 4*e* thereof an engagement groove 4*z* into which the shelf thickness adjustment vertical board 4*d* at its lower end is engaged.

With such an engagement groove 4*z* provided in the lower member 4B, as shown in FIG. 9B, it will be noted that in case where the shelf board 3 of smaller thickness should be held between the shelf board holding upper and lower board portions 4*b* and 4*e* of the upper and lower members 4A and 4B, the lower end of the shelf thickness adjustment vertical board 4*d* of the upper member 4A is engaged into the engagement groove 4*z* of the lower member 4B so that even the thinner shelf board 3 can be strongly held between the shelf board holding upper board portion 4*b* of the upper member 4A and the shelf board holding lower board portion 4*e* off the lower member 4B.

Figure 3:
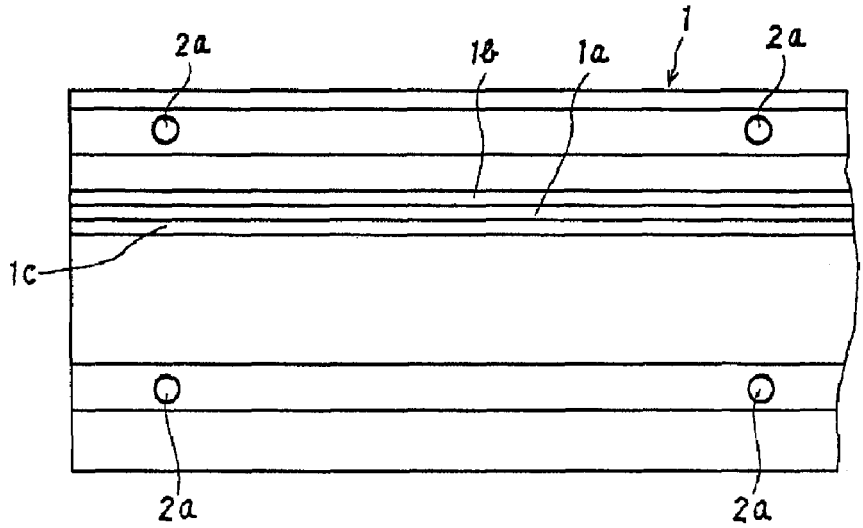
FIG. 3 is a front view of a portion of a wall body attachment unit of FIG. 1.

A method of attaching thee shelf board 3 to the shelf bracket of the invention will be explained in connection with FIGS. 1 through 3.

As shown in FIG. 1, the wall body attachment unit 1 can be attached by the securing screws 2 to the wall body W, but alternatively may be attached to the wall body W by any suitable means such as adhesives instead of the securing screws 2. The wall body attachment unit 1 has a predetermined transverse length in accordance with the width (transverse size) of the shelf board 3, but it is not required to have the same length as the width of the shelf board 3 and may be shorter than that.

In the illustrated embodiment, on the front face of the wall body attachment unit 1 is provided the groove-like engaged portion 1*a* upwardly curved so as to be opened on the front face. Of course, this engaged portion 1*a* is not in the form of groove, but may be in the form of convex portion protruding forwardly.

On the other hand, separately from the operation of attaching the wall body attachment unit 1, the operation of supporting the shelf board 3 on the shelf board support unit 4 is performed at the same time, before or after this operation of attaching the wall body attachment unit 1. The operation of supporting the shelf board can be performed at the low place on the ground without any relation to the wall body W. A method of supporting the shelf board 3 on the shelf board support unit 4 is as already described with reference to FIGS. 1 and 2. The shelf board support unit 4 having the shelf board 3 supported thereon has the convex engagement portion 4*a* protruding upwardly curved toward the back of the leading end face 3*a* of the shelf board 3 (in the leftward direction as viewed in FIG. 1). This engagement portion 4*a* has such configuration and size as complement the depression-like engaged portion 1*a* of the wall body attachment unit 1.

Accordingly, the shelf board support unit 4 can be secured to the wall body attachment unit 1 by engaging the engagement portion 4*a* of the shelf board support unit 4 having the shelf board 3 supported thereon into the engaged portion 1*a* of the wall body attachment unit 1 already attached onto the wall body W and turning the shelf board support unit 4 in the clockwise direction as viewed in FIG. 1 until the wall body support portion 4*p* of the support leg 4*r* engages the wall body W. The operation of attaching the shelf board support unit 4 can be done while manually handling the shelf board 3 having the shelf board support unit 4 attached thereto. In this case, the extensible and contractible adjustment portion 4*q* of the support leg 4*r* has the function of adjusting the length of the support arm 4*m* so that the shelf board 3 is maintained in a horizontal manner.

In this manner, the shelf board 3 is secured to the wall body W and can be removed from the wall body W by upwardly withdrawing the shelf board 3 while manually turning it on this side in the counterclockwise direction as viewed in FIGS. 1 and 2, if necessary.

In the illustrated form, the wall body W may comprise joists J, outer wall panels P and finish panels MP. The wall body attachment unit 1 is attached directly to the joists J, the outer wall panels P are adhered to the portion excluding the wall body attachment unit 1 and the finish panels MP are adhered to the portion of the outer wall including the wall body attachment unit 1, but excluding the engaged portion 1*a* thereof.

Thus, since only the engaged portion 1*a* of the wall body attachment unit 1 and its upper and lower edges 1*b* and 1*c* are exposed on the surface of the finish panels MP, the appearance is never damaged.

POSSIBILITY OF UTILIZATION IN INDUSTRIES

According to the invention, since the shelf board can be supported on the shelf board support unit at a low position without any relation to the position where it is attached on a wall body while adjusting the shelf board support unit in accordance with the thickness of the shelf board, the operation at high position can be lessened and the operation of attaching the shelf board can be done in a safe and effective manner and, therefore, this invention can be advantageously used for attaching various shelf boards.

The invention claimed is:

1. A shelf bracket characterized by comprising a wall body attachment unit having an engaged portion of depression or projection formed by being upwardly or downwardly curved or bended to be capable of being attached to a wall body and a shelf board support unit having an engagement portion of projection or depression formed by being upwardly or downwardly curved or bended to be engaged with said engaged portion of said wall body attachment unit to be removably attached to one side end of a shelf board, said shelf board support unit comprising an upper member including a forcing upper board having a shelf board holding upper board portion provided integrally with said engagement portion and a shelf thickness adjustment vertical board suspending from said forcing upper board and a lower member including a shelf board holding lower board portion on which said shelf board is to be mounted and a shelf thickness adjustment vertical board extending vertically and upwardly from said shelf board holding lower board portion, and said shelf thickness adjustment vertical board of said lower member and said shelf thickness adjustment vertical board of said upper member being slipperily engaged with each other and secured to each other by screws whereby said one side end of said shelf board is held between said shelf board holding lower board portion of said lower member and said shelf board holding upper board portion of said upper member.

2. A shelf bracket as set forth in claim 1, and wherein said shelf thickness adjustment vertical board of said upper member has shelf thickness adjustment elongated holes, said shelf thickness adjustment vertical board of the lower member comprises a pair of board walls having an engagement groove provided with an upward opening into which said shelf thickness adjustment vertical board of said upper member is to be engaged and said pair of board walls of said shelf thickness adjustment vertical board of said lower member is in the form of having screw head extending holes and screw threading holes, respectively.

3. A shelf bracket as set forth in claim 1, and wherein said shelf thickness adjustment vertical board of said lower member has a shelf thickness adjustment elongated hole, said shelf thickness adjustment vertical board of said upper member comprises a pair of board walls having an engagement groove provided with a downward opening into which said shelf thickness adjustment vertical board of said lower member is to be engaged, and said pair of board walls of said shelf thickness adjustment vertical board of said upper member is in the form of having screw head extending holes and screw threading holes, respectively.

4. A shelf bracket as set forth in claim 1, and wherein said shelf thickness adjustment vertical board of said upper member has shelf thickness adjustment elongated holes and said shelf thickness adjustment vertical board of said lower member has screw threading holes.

5. A shelf bracket as set forth in claim 1, and wherein said shelf thickness adjustment vertical board of said lower member has shelf thickness adjustment elongated holes and said shelf thickness adjustment vertical board of said upper member has screw threading holes.

6. A shelf bracket as set forth in claim 1, and wherein said shelf thickness adjustment vertical boards of said upper and lower members have slip prevention roughness provided on the forcing surfaces faced to each other.

7. A shelf bracket characterized by comprising a wall body attachment unit having an engaged portion of depression or projection formed by being upwardly or downwardly curved or bended to be capable of being attached to a wall body and a shelf board support unit having an engagement portion of projection or depression formed by being upwardly or downwardly curved or bended to be engaged with said engaged portion of said wall body attachment unit to be removably attached to one side end of a shelf board, said shelf board support unit comprising an upper member including a forcing upper board having an upper holding board portion provided integrally with said engagement portion and a shelf thickness adjustment vertical board suspending from said forcing upper board and a lower member including a lower holding board portion on which said shelf board is to be mounted and a shelf thickness adjustment vertical board extending vertically and upwardly from said lower holding board portion, and said shelf thickness adjustment vertical board of said lower member and said shelf thickness adjustment vertical board of said upper member being slipperily engaged with each other and secured to each other by screws whereby said one side end of said shelf board is held between said shelf board holding lower board portion of said lower member and said shelf board holding upper board portion of said upper member; said lower member including a support leg comprising a wall body support portion to engage with said wall body and an extensible and contractible adjustment portion extending from said wall body support portion, said support leg being secured by an adjustment screw to a leading end of an support arm downwardly extending from a leading end of said shelf board holing lower board portion of said lower member toward said wall body while being adjusted in position relative to each other.

8. A shelf bracket as set forth in claim 7, and wherein said adjustment portion of said support leg and a leading end of said support arm have slip prevention roughness provided on the forcing surfaces faced to each other.

9. A shelf bracket characterized by comprising a wall body attachment unit having an engaged portion of depression or projection formed by being upwardly or downwardly curved or bended to be capable of being attached to a wall body and a shelf board support unit having an engagement portion of projection or depression formed by being upwardly or downwardly curved or bended to be engaged with said engaged portion of said wall body attachment unit to be removably attached to one side end of a shelf board, said shelf board support unit comprising an upper member including a forcing upper board having a shelf board holding upper board portion provided integrally with said engagement portion and a shelf thickness adjustment vertical board suspending from said forcing upper board and a lower member including a lower holding board portion on which said shelf board is to be mounted and a shelf thickness adjustment vertical board extending vertically and upwardly from said lower holding board portion; and screws extending through and attached by said shelf thickness adjustment vertical board of said lower member to be attached thereto and extending through said shelf thickness adjustment vertical board of said upper member so as to be vertically movable relative to said shelf thickness adjustment vertical board of said upper member and being threadedly engaged into said one side end of said shelf board whereby said one side end of said shelf board is held between said shelf board holding lower board portion of said lower member and said shelf board holding upper board portion of said upper member.

10. A shelf bracket as set forth in claim 9, and wherein said screws extend from head extending holes in said shelf adjustment vertical board of said lower member through thickness adjustment elongated holes in said shelf adjustment vertical board in said upper member to be threadedly engaged into said one side end of said shelf board; said lower member has an engagement groove provided between said shelf thickness adjustment vertical board of said lower member and said shelf board holding lower board portion thereof and into which said shelf thickness adjustment vertical board of said upper member is engaged, and in case where said shelf board of small thickness is to be attached, said lower end of said shelf thickness adjustment vertical board of said upper member is engaged into said engagement groove.

11. A shelf bracket as set forth in claim 2, and wherein said shelf thickness adjustment vertical boards of said upper and lower members have slip prevention roughness provided on the forcing surfaces faced to each other.

12. A shelf bracket as set forth in claim 3, and wherein said shelf thickness adjustment vertical boards of said upper and lower members have slip prevention roughness provided on the forcing surfaces faced to each other.

13. A shelf bracket as set forth in claim 4, and wherein said shelf thickness adjustment vertical boards of said upper and lower members have slip prevention roughness provided on the forcing surfaces faced to each other.

14. A shelf bracket as set forth in claim 5, and wherein said shelf thickness adjustment vertical boards of said upper and lower members have slip prevention roughness provided on the forcing surfaces faced to each other.

* * * * *